US006644479B1

(12) United States Patent
Kimmeyer et al.

(10) Patent No.: US 6,644,479 B1
(45) Date of Patent: Nov. 11, 2003

(54) METHOD AND AIR SEPARATOR FOR CLASSIFYING CHARGING MATERIAL REDUCED IN SIZE

(75) Inventors: Ludger Kimmeyer, Beckum (DE); Robert Schnatz, Hamm (DE)

(73) Assignee: Krupp Polysius AG, Beckum (DE)

( * ) Notice: Subject to any disclaimer, the term of this patent is extended or adjusted under 35 U.S.C. 154(b) by 315 days.

(21) Appl. No.: 09/937,861

(22) PCT Filed: Sep. 4, 2000

(86) PCT No.: PCT/EP00/08629

§ 371 (c)(1),
(2), (4) Date: Apr. 10, 2002

(87) PCT Pub. No.: WO01/21328

PCT Pub. Date: Mar. 29, 2001

(30) Foreign Application Priority Data

Sep. 23, 1999 (DE) ..... 199 45 646

(51) Int. Cl.[7] ..... B07B 7/00

(52) U.S. Cl. ..... 209/154; 209/143; 209/714

(58) Field of Search ..... 209/133, 142, 209/143, 154, 710, 713, 714, 715, 716

(56) References Cited

U.S. PATENT DOCUMENTS 5,624,039 A * 4/1997 Folsberg ..... 209/714
6,276,534 B1 * 8/2001 Huang et al. ..... 209/714 X

FOREIGN PATENT DOCUMENTS

EP 0 406 591 B1 8/1994
EP 195 05 466 A1 8/1996
WO 94/25184 * 11/1994 ..... 209/714

* cited by examiner

*Primary Examiner*—Tuan N. Nguyen
(74) *Attorney, Agent, or Firm*—Muramatsu & Associates

(57) ABSTRACT

A method of grading comminuted charging material in a wind sifter having a sifting rotor. The sifting air and the charging material are introduced into a sifting chamber and blocking air is blown into a ring seal region in the transition region between the sifting rotor and a stationary withdrawal duct. In order to be able to adjust the grain size distribution range in the fine material/end product in a reliable manner and with relatively little structural outlay, the grain size distribution in the discharged fine material is adjusted in a selective manner with the aid of a bypass stream, which flows in an alterable volume from the sifting chamber into the withdrawal duct and which is charged with sifter charging material or sifter grit, by controlling the supply of blocking air.

8 Claims, 3 Drawing Sheets

METHOD AND AIR SEPARATOR FOR CLASSIFYING CHARGING MATERIAL REDUCED IN SIZE

FIELD OF THE INVENTION

The invention relates to a method and a wind sifter for grading comminuted charging material (sifting material).

BACKGROUND OF THE INVENTION

Methods and wind sifters of the type required are known in various forms from practice. Those wind sifters are so-called dynamic wind sifters in which an approximately basket-form sifting rotor, whose outer circumference is equipped with sifting strips or the like, is generally rotatably supported and driven inside a sifter housing. A substantially annular sifting chamber which is generally also surrounded by a vane ring radially towards the outside is formed above all in the region of the outer circumference, that is to say, around the sifting rotor. A tubular withdrawal duct for sifting air charged with fine material adjoins at least one end face of the sifting rotor which is generally rotating about a horizontal or upright axis. Sifting air and charging material are introduced into the sifting chamber in a suitable manner.

While the heavier coarse material falls out substantially downwards and is drawn off by way of a suitable collecting chamber for coarse material, the fine material is removed together with the sifting air first through the circumference of the rotor and into the inside of the sifting rotor and then from there through at least one end face into the withdrawal duct, while applying an appropriate partial vacuum, and from there into a suitable separating or filtering device. The fineness of the fine material which is discharged with the stream of sifting air, and which can be drawn off as fine material, can be adjusted within a suitably large range by the speed of the sifting rotor and/or by regulation of the amount of sifting air.

In sifting methods and wind sifters of the above-mentioned type, there are also provided, in the transition region from the appropriate end face of the sifting rotor to the stationary withdrawal duct, annular-blocking-air sealing regions into which blocking air is introduced in such an amount and under such a pressure that a bypass stream from the sifting chamber into the withdrawal duct can be suppressed as far as possible, and preferably completely. Thus the intention is quite deliberately to prevent portions of coarse grain or grit from passing with the bypass stream into the withdrawal duct for sifting air and fine material in order thereby to ensure that the fine material has a relatively high degree of fineness.

In the manufacture of cement from cement clinker, granulated blast-furnace slag and the like, the comminution of those starting materials has increasingly involved a transition to energy-saving grinding methods or grinding systems in which the comminution work is carried out above all in material bed cylinder crushers and roller mills, or bowl mill crushers, downstream of which are arranged dynamic heavy-duty sifters. Admittedly, in that method of grinding cement, the aim is, inter alia, to obtain relatively high product fineness; however, with those product fineness, specific quality properties of the cement are to be observed. This also includes the amount of water required to achieve the standard consistency, that is to say, an increased addition of water to the so-called standard stiffness corresponds as a rule to an increased water requirement on the part of the concrete.

In this connection, it is already known that cements that are ground with grinding systems or grinding methods containing a material bed cylinder crusher or a roller mill require more water than do cements that are produced, for example, in grinding systems having ball mills. The consequence of that higher water requirement (higher water-cement ratio) is a higher pore volume of the cement mortar which leads to a lower standard strength of the cement-mortar prisms. This undesirably higher water requirement for cements that are ground in grinding systems having material bed cylinder crushers or roller mills is basically attributed to a relatively narrow grain size distribution.

The grain size distribution in cement and cement-like products is normally presented as a cumulative mass distribution in the so-called "RRSB diagram" (after Rosin, Rammler et al.) in which the axis scales are so selected that the cumulative mass distributions of normal mineral comminution products appear in the form of straight lines, the cumulative distributions being described by two parameters, namely by the slope n and the parameter of position d', the slope n indicating at what angle a mean straight line extends (for example $n=\tan\alpha=1.0=45°$), that is to say, the greater the slope n, the steeper the curve characteristic in the RRSB diagram, while the parameter of position d' fixes the grain size in $\mu$m on the mean straight line at a specific screening residue (residue value) of 36.8%.

The fineness of cement, blast furnace powder or the like is usually indicated as a mass-related surface in Blaine ($cm^2/g$). The higher that degree of fineness is, the greater are also the strengths of concretes and mortars produced therefrom. Depending on the use for which a cement is intended, the grain fineness and the water absorption capacity of the cement, and thus the strength and workability, must be in accordance with one another.

In order, in grinding methods and grinding systems in which material bed cylinder crushers or roller mills are used for comminution and dynamic heavy-duty sifters are used for grading, to be able to achieve a sufficiently broad grain size distribution, or a sufficiently large grain band width (by an appropriate slope n in the RRSB diagram), even with relatively high degrees of fineness of the end product (fine material), it has also already been proposed to convey the comminuted charging material (sifting material) to be graded to a grading stage comprising at least two grading units which are adjusted to different degrees of fineness and to each of which selectable partial streams of the charging material are conveyed and whose fine material portions are mixed with one another.

Thus the end product (fine material as a whole) is also to be adapted in respect of its processing behavior and its strength development to the quality standard which is produced in grinding systems having ball mills (see EP-A-0 406 591). However, it must be accepted that at least some of the energy saving gained in the comminution of the starting materials will be lost again through the amount of equipment used in grading the comminuted charging material (for example, grading stage having at least two grading units).

SUMMARY OF THE INVENTION

It is, therefore, an object of the present invention to provide an improved sifting method and a wind sifter using the sifting method in which the grain size distribution and therefore the grain band width in the fine material, or the end product, can be adjusted reliably and with relatively low structural expenditure, with sufficiently great leeway.

An important concept of the present invention is regarded as being the fact that the grain size distribution in the discharged fine material, which can be drawn off as the end product, is adjusted with the aid of a bypass stream, which flows in an alterable volume from the sifting chamber into the withdrawal duct (for the mixture of sifting air and fine material) and which is charged with sifter charging material or sifter grit (bypass material), by controlling the volume of that bypass stream by very selective adjustment of the blocking air supply in terms of its amount.

Therefore, whereas in the known construction described in the introduction (DE-A-195 05 466) the blocking air is blown into the ring seal region between the sifter rotor and the stationary withdrawal duct quite deliberately for the sole purpose of preferably preventing any bypass stream and thus any spray grain (that is to say, sifter charging material or sifter grit) from passing into the withdrawal duct for the mixture of sifting air and fine material, according to the present invention the blocking air supply is used to ensure that an adjustable portion of the bypass stream charged with the so-called bypass material is introduced very selectively into the mixture of sifting air and fine material in the withdrawal duct in such an amount that the grain size distribution range of the fine material, or end product, can thereby be controlled in the necessary manner.

This control of the grain size distribution range (grain band width) in the fine material can be carried out extremely reliably and reproducibly. Since, for this control, only the blocking air supply has to be adjusted in terms of its amount and/or pressure, the grading operation can be carried out in a single wind sifter, that is to say, with regard to the known construction according to EP-A-0 406 591, the arrangement of at least two grading units, or wind sifters, connected in parallel can be dispensed with, which means a substantial reduction in expenditure on equipment.

The method according to the invention can be used very especially advantageously and very selectively in the case of high product fineness, it nevertheless being possible to adjust an optimum grain size distribution, or distribution range, for the particular use for which the fine material, or end product, is intended, that is to say, an optimum compromise can also be achieved with respect to the quality properties of the product, that is to say, between the standard compressive strength and the workability of the end product, for example cement.

In the tests on which the invention is based, it was found to be very advantageous if the amount of blocking air supplied was adjustable in a range of approximately from 5 to 25%, preferably approximately from 10 to 20%, of the amount of sifting air supplied to the sifting chamber. Advantageously, a smaller amount of blocking air is adjusted if the fine material has a relatively low degree of fineness and a larger amount of blocking air is adjusted if the fine material (end product) has a relatively high degree of fineness.

Those tests achieved, for example, with a proportion of blocking air of approximately 10%, a —relatively low— product fineness in the case of cement or granulated blast-furnace sand of approximately 3000 Blaine ($cm^2/g$) with a parameter of position d' (in the RRSB diagram) of approximately from 16 to 20 $\mu$m, whereas, with a proportion of blocking air of approximately 20%, a relatively high product fineness was achieved, for example, for cement or granulated blast-furnace sand, with approximately 5000 Blaine ($cm^2/g$) with a parameter of position d' of approximately from 8 to 12 $\mu$m, the larger amount of blocking air (higher product fineness) leading to a higher slope n than in the case of the lower proportion of blocking air (for relatively low product fineness).

According to a further form of the invention, it is considered advantageous if the pressure level of the blocking air supplied is controlled in accordance with the load on the sifter and the static pressure in the withdrawal duct (behind the sifting rotor) for the mixture of sifting air and fine material. It is thus possible to ensure in a suitable and adequate manner that the pressure loss in the withdrawal duct is overcome by the supplied blocking air, or amount of blocking air. It should be mentioned in this connection that the pressure loss in the withdrawal duct depends above all on the charge of fine material in the sifting air, the amount of sifting air, the rotor speed, and the like, a high charge, a large amount of sifting air and a high rotor speed resulting in a high pressure loss and vice versa.

A wind sifter in a form according to the invention is distinguished by the fact that a control device co-operating with the blocking air supply is provided to adjust the grain size distribution in the discharged fine material, a bypass guide connecting the sifting chamber to the withdrawal duct by way of the ring seal and the blocking air supply connected to the ring seal being adjustable in respect of the pressure and/or the amount of the blocking air in such a manner that a bypass stream leaving the sifting chamber and charged with spray grain can be introduced in a controllable volume through the bypass guide into the withdrawal duct for the mixture of sifting air and fine material.

BRIEF DESCRIPTION OF THE DRAWINGS

The invention will be explained in more detail hereinafter with reference to the drawings.

DETAILED DESCRIPTION OF THE INVENTION

Figure 1:
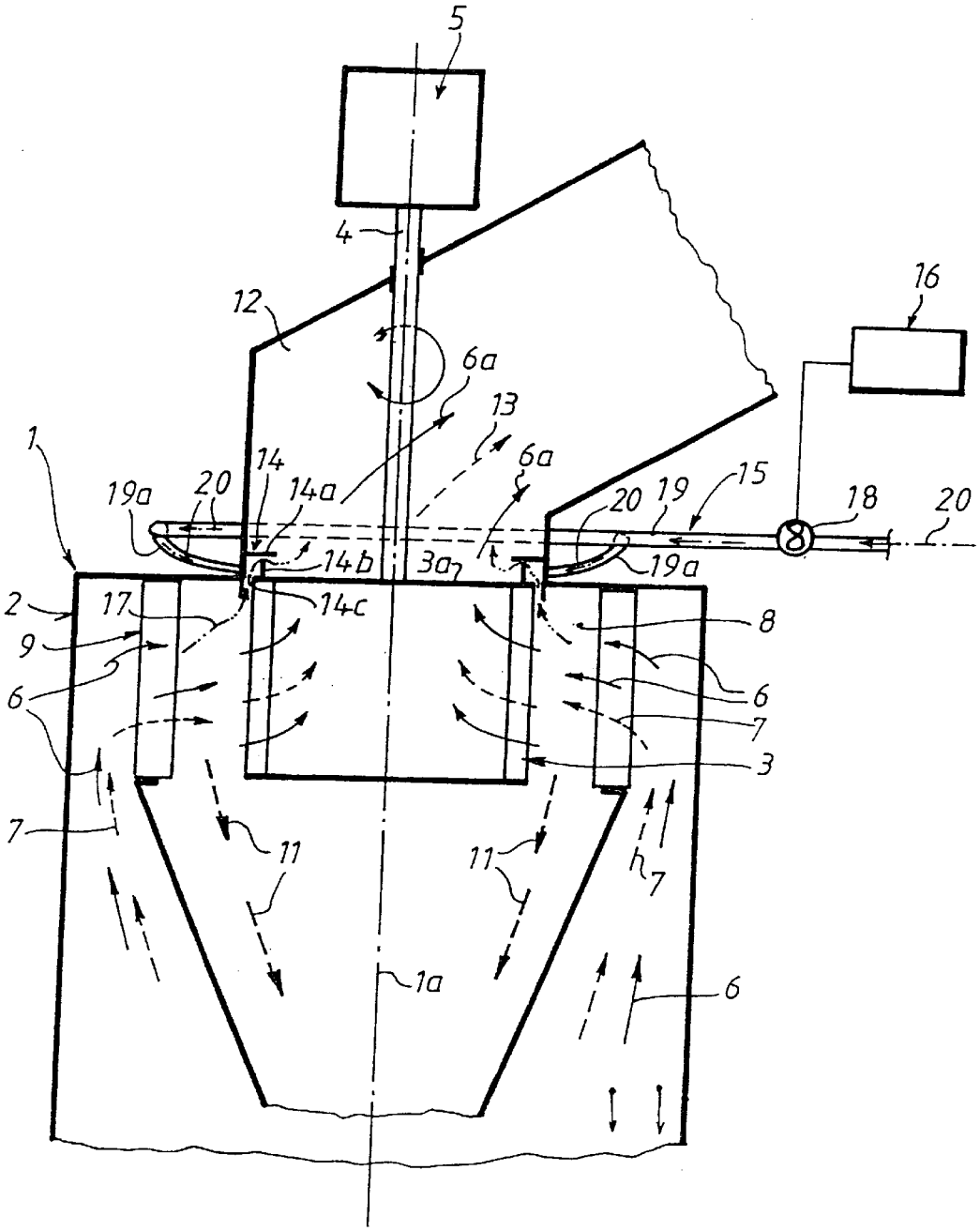
FIG. 1 is a greatly schematised view of a wind sifter a form according to the invention in vertical section.

The wind sifter 1 shown in a simplified and very schematic manner in FIG. 1 is a dynamic heavy-duty sifter of which, however, basically only the portions necessary to explain the present invention are shown. The wind sifter 1 is used to grade previously comminuted material, that is to say, charging material or sifting material, into at least two grain fractions (coarse material and fine material).

In this wind sifter, a sifting rotor 3 is arranged in an outer sifter housing 2 and can be driven by a suitable drive 5 at a preferably adjustable speed by way of a drive shaft 4. In the embodiment according to FIG. 1, the wind sifter 1 is one having an upright axis la which coincides with the upright axis of rotation of the rotor 3. The rotor 3 is supported rotatably and substantially centrally in the upper end of the sifter housing 2.

The sifting rotor 3 is surrounded by a sifting chamber 8 which can be acted upon with sifting air (continuous arrows 6) and charging material, or sifting material, (thin broken arrows 7) and which is preferably delimited radially towards the outside, as known per se, by an outer vane ring 9.

A coarse material collecting chamber 10 for catching and removing the coarse material falling out in a downward direction in the sifting chamber (thick broken arrows 11) is arranged at least partially beneath the sifting chamber 8.

In the embodiment according to FIG. 1, the upper end face 3*a* of the sifting rotor 3 is adjoined by a stationary withdrawal duct 12 which, as will be explained in more detail later, is to draw off or suck off the sifting air stream (continuous arrows 6*a*) charged with fine material (broken arrows 13) and which is connected to a separating or filtering device not shown in detail (because it is general state of the art).

A circumferential ring seal 14 which is connected to a blocking air supply or blocking air supply device 15 is formed in the transition region between the rotationally drivable sifting rotor 3, or its upper end face 3*a*, and the stationary withdrawal duct 12.

In this wind sifter 1, the fineness of the end material 13 can in principle be adjusted in a manner known per se by the speed of the sifting rotor 3 and/or by regulation of the amount of sifting air. In addition, however, as already explained above in connection with the method, measures are provided in order to adjust or control the grain size distribution in the discharged fine material (broken arrow 13) in a selective manner.

Accordingly, this wind sifter 1 according to the invention is provided with a control device 16, as indicated only schematically in FIG. 1, which co-operates in a suitable manner with the blocking air supply 15 for the purpose of adjusting the grain size distribution in the discharged fine material 13.

The sifting chamber 8 is connected to the withdrawal duct 12 via the ring seal 14 by a bypass guide through which a bypass stream leaving the sifting chamber 8 and charged with spray grain (coarse material fraction or grit fraction) can flow over into the withdrawal duct 12 in accordance with the dash-dot-dot arrows 17 (FIG. 1). For that purpose, the ring seal 14 may be in a relatively simple form such that, in any case, a maximum permissible bypass stream 17 and therefore a sufficiently large amount of spray grain can pass from the sifting chamber 8 into the withdrawal duct 12.

The blocking air supply 15 contains a blocking air fan 18 which can advantageously be regulated in terms of its supply quantity (amount of blocking air) and/or its pressure level (pressure of the blocking air) from the control device 16. Thus, the blocking air supply 15 connected to the ring seal 14 can be regulated with respect to the blocking air pressure and/or the amount of blocking air in such a manner that the bypass stream 17 leaving the sifting chamber 8 and charged with spray grain can be introduced through the bypass guide and in a controllable volume into the withdrawal duct 12 for the mixture of sifting air and fine material and therefore can also be mixed into that mixture. Thus, at the same time, the proportion of spray grain desired or necessary in the fine material 13 and therefore in turn, as explained above, the grain band width of the fine material, or the end product, can be controlled in a very selective manner. Since the bypass stream 17 in the sifter cross-section flows in an annular shape out of the sifting chamber 8 and by way of the ring seal 14 into the withdrawal duct 12, that spray grain fraction is also mixed into the fine material 13 in an especially uniform manner.

The representation in FIG. 1 also shows that the blocking air supply 15 has a main supply line 19 surrounding the lower end of the withdrawal duct 12 in an annular manner and also several subsidiary blocking air lines 19*a* branching off therefrom which are uniformly distributed over the circumference of the main supply line 19 and, at the same time, also over the circumference of the ring seal 14 and are connected to that ring seal 14 so that they open out in a suitable manner into that ring seal 14. The blocking air is symbolized by dot-dash arrows 20.

As has been indicated above, the ring seal 14 may be in a relatively simple form, as can also be seen in FIG. 1. Accordingly, the ring seal 14 may have only an annular, stationary sealing member 14*a* secured to the inner wall of the stationary withdrawal duct 12 and an annular rotating sealing member 14*b* secured to the upper end face 3*a* of the sifting rotor 3, the stationary sealing member 14*a* pointing approximately horizontally and radially into the inside of the withdrawal duct 12, while the rotating sealing member 14*b* is substantially approximately cylindrical and points axially in the direction towards the stationary sealing member 14*a* and terminates at an appropriate distance therefrom. Thus, an annular space 14*c* is delimited through which, on the one hand, the bypass stream 17 passes and into which, on the other hand, the blocking air (arrows 20) is introduced. Those two sealing members 14*a* and 14*b* are therefore associated with one another also in such a manner as to deflect the airstreams supplied (blocking air 20 and bypass stream 17).

Figure 2:
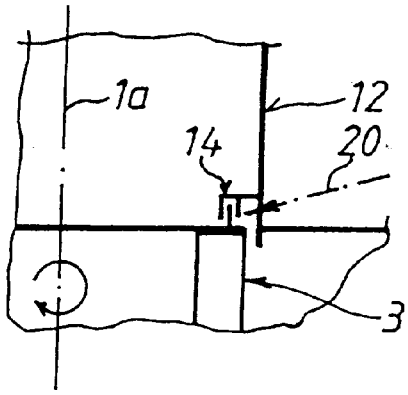
FIGS. 2 to 4 are greatly simplified detailed views in vertical section (sectioned in a similar manner to FIG. 1) for various embodiment variants in the transition region between the sifting rotor and the withdrawal duct, or in the region of a ring seal.
Figure 3:
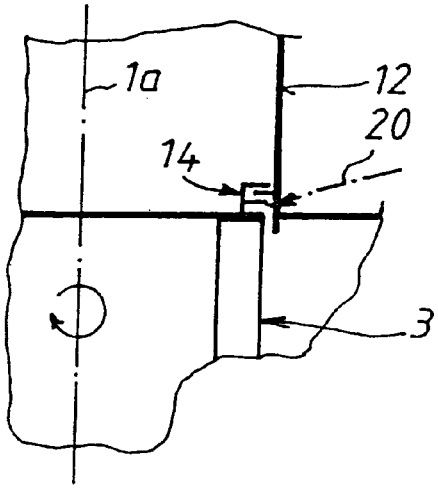
Figure 4:
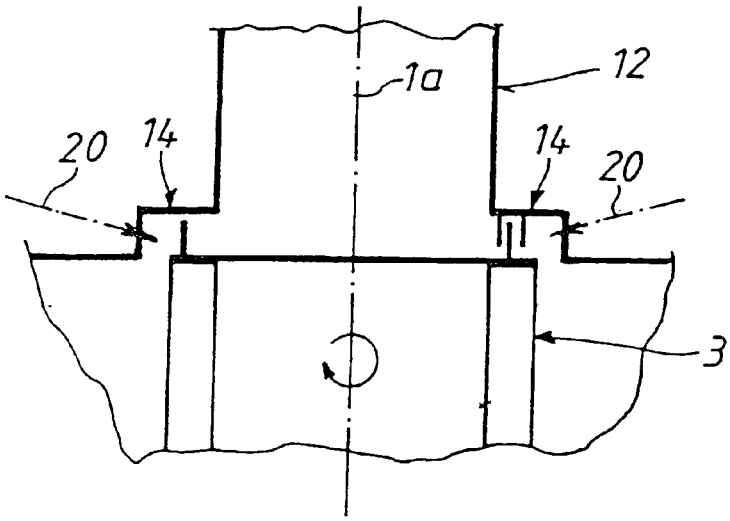

The detailed representations in FIGS. 2, 3, and 4 show that the ring seal 14, while having a substantially similar basic structure to begin with, can also be varied in accordance with the particular requirements of the wind sifter 1 in that, using stationary and/or rotating sealing members, a more or less air deflection or single or multiple air deflection and optionally also a structure of the labyrinth seal kind can be built up in which the various sealing members are associated with one another in such a manner that they engage in one another. Since the representations in those Figures speak for themselves, they do not require further explanation.

Irrespective of in what form the ring seal 14 is selected for the wind sifter 1 according to the invention, it is always important that, as already described several times, a sufficiently large bypass stream 17 and therefore a sufficient amount of spray grain can pass from the sifting chamber 8 through the ring seal 14 into the withdrawal duct 12, or into the fine material/end product 13, and that the volume of that bypass stream 17 can be controlled in a very selective manner with the aid of the blocking air supply 15, that is to say, by regulating the amount and/or the pressure of the blocking air 20. As a result, the wind sifter 1 is optimally suited to carrying out the method according to the invention described above.

As regards the structure of the wind sifter according to the invention, it may be added that the embodiment illustrated in FIG. 1 can in principle also be modified in various ways, as is known per se in the case of such dynamic sifters having basket-like sifting rotors, without thereby departing from the principle of the invention.

For example, it is also possible for the withdrawal duct for the mixture of sifting air and fine material not to adjoin the upper end face of the sifting rotor 3 but to adjoin the lower end face. In addition, it is also possible to associate a respective withdrawal duct for a portion of the mixture of sifting air and fine material both with the upper end face and with the lower end face of the sifting rotor, although a corresponding blocking air supply must then be arranged in each transition region, and the sifting rotor could also be divided into an upper rotor portion and a lower rotor portion or it could also be formed by two separate rotor portions which adjoin one another directly and co-axially. The last-mentioned variant is suitable for especially high throughput.

While FIG. 1 shows an example in which the wind sifter 1 may be arranged immediately above a roller mill or a bowl mill crusher or at the upper end of a common supply duct for sifting air and charging material, the wind sifter according to the invention may in principle be in the form of a separate structural unit and may also have separate means for conveying sifting air and charging material into the sifting chamber.

Figure 5:
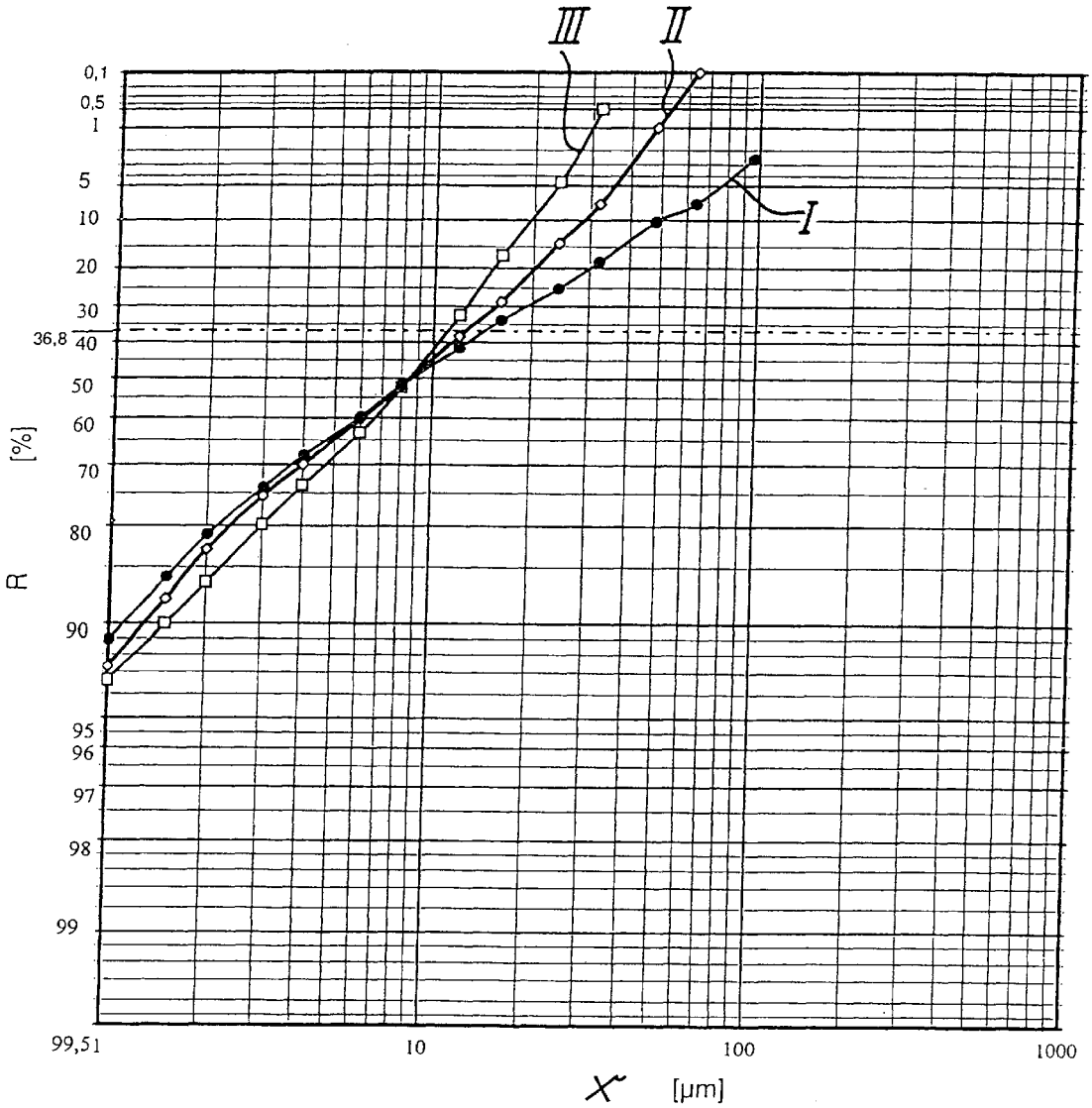
FIG. 5 is an RRSB diagram.

Finally, FIG. 5 illustrates an RRSB diagram which shows the grain size distributions obtained with three typical grading tests, which were obtained, inter alia, in the tests upon which the invention is based. The grain size distributions of those three tests are illustrated in the RRSB diagram according to FIG. 5 by the curves I, II and III, the grain size x being entered in $\mu$m on the abscissa and the residue (screening residue) being entered in percentage by mass on the ordinate and a (horizontal) mean straight line being entered with a dot-dash line at the residue value 36.8% by mass (corresponds to R (x=d')=36.8% by mass).

The following Table gives the principal data for the three grading tests I, II and III, which data were adjusted or recorded during the grading of blast-furnace slag comminuted in a roller mill or a bowl mill crusher (for example for use in blast-furnace cement).

| | | | |
|---|---|---|---|
| Sifting air quantity [$m^3$/h] | 3000 | 3000 | 4000 |
| Blocking air quantity [$m^3$/h] | without | 300 | 600 |
| Circumferential rotor speed [m/s] | 31.5 | 12.7 | 25.4 |
| Product fineness according to Blaine [$cm^2$/g] | 5120 | 5125 | 5141 |
| Slope n | 0.74 | 0.96 | 1.23 |
| Grain size d' [$\mu$m] | 15.2 | 12.5 | 10.7 |

Test I was carried out without the supply of blocking air. In test II, a quantity of blocking air of 300 $m^3$/h, that is to say, a proportion of 10% of the amount of sifting air, was used, while, in test III, an amount of blocking air of 600 $m^3$/h, that is to say, 15% of the amount of sifting air (400 $m^3$/h), was used. Furthermore, whereas in tests I and II the amount of sifting air was equal at 3000 $m^3$/h, it was 4000 $m^3$/h in test III. Other differences between the three tests can be seen in the circumferential speeds of the rotor, according to which in test I (without blocking air) the rotor was running at 31.5 m/s, in test II at 12.7 m/s and in test III at 25.4 m/s.

The data for the grain size distributions of the three tests show, especially, the clear differences, with the slope in test I, that is to say, without the supply of blocking air, with n at 0.74 being the lowest, while the slope n in test II was 0.96 and in test III 1.23; accordingly, parameters of position d' of 15.2 $\mu$m in test I, 12.5 $\mu$m in test II and 10.7 $\mu$m in test III were obtained. Accordingly, in tests II and III, that is to say, in the tests with a selectively controlled supply of blocking air and therefore with a selectively controllable bypass stream from the sifting chamber to the withdrawal duct, greater fineness (characterized by the particular parameter of position d=) was achieved in the withdrawn fine material, or end product, than in test I.

Those facts are also made especially clear by curves I, II and III drawn in FIG. 5, that is to say, the curves make it especially clear that, using the grading method according to the invention, the grain size distribution range in the withdrawn fine material, or end product, can be controlled within relatively wide limits.

Accordingly, it will also be readily appreciated that, if the mentioned bypass stream were completely suppressed (by means of a correspondingly large supply of blocking air), the fine material could have an even greater degree of fineness as a result of rigorous sifting, but then the corresponding curve, or the corresponding slope n, would also be correspondingly steeper than curve III in FIG. 5. This last-mentioned fact makes it even clearer that, by means of the grading method according to the invention, the grain size distribution range in the end product can be adjusted within especially wide limits by using the method according to the invention.

What is claimed is:

1. A method for grading comminuted charging material in a wind sifter having at least one driven sifting rotor, comprising the following steps of:

introducing sifting air and charging material into a sifting chamber;

separating coarse material substantially downwards from the sifting chamber and sucking a sifting air stream charged at least with fine material initially from the rotor circumference into the inside of the sifting rotor and then approximately axially at least one end face of the rotor into a stationary withdrawal duct; and blowing blocking air into a ring seal region in the transition region between the sifting rotor and the stationary withdrawal duct;

wherein the grain size distribution in the discharged fine material is adjusted with the aid of a bypass stream, which flows in an alterable volume from the sifting chamber into the withdrawal duct and which is charged with sifter charging material or sifter grit, by controlling the volume of that bypass stream by adjustment of the blocking air supply in terms of its amount.

2. A method according to claim 1, wherein the amount of blocking air supplied can be adjusted in a range of approximately from 5 to 25%, preferably approximately from 10 to 20%, of the amount of sifting air supplied to the sifting chamber, a smaller amount of blocking air being adjusted if the fine material has a relatively low degree of fineness and a larger amount of blocking air being adjusted if the fine material has a relatively high degree of fineness.

3. A method according to claim 1, wherein the pressure level of the blocking air supplied is controlled in accordance with the load on the sifter and the static pressure in the withdrawal duct for the mixture of sifting air and fine material.

4. A wind sifter for grading comminuted charging material, comprising:

at least one sifting rotor which is arranged in a sifter housing and which can be driven in rotation;

a sifting chamber which surrounds the sifting rotor and which can be acted upon with sifting air and charging material;

at least one coarse material collecting chamber arranged at least partially below the sifting chamber;

at least one stationary withdrawal duct for a sifting air stream charged with fine material, which duct adjoins an end face of the sifting rotor;

a ring seal which is formed in the transition region between the sifting rotor and the stationary withdrawal duct and which is connected to a blocking air supply;

a control device co-operating with the blocking air supply in order to influence the grain size distribution range in the discharged fine material; and a bypass guide connecting the sifting chamber to the withdrawal duct by way of the ring seal;

wherein the speed of the sifting rotor or the amount of sifting air being adjustable, and wherein the blocking air supply connected to the ring seal is adjustable in respect of the pressure or the amount of the blocking air in such a manner that a bypass stream leaving the sifting chamber and charged with sifter charging material or sifter grit can be introduced in a controllable volume through the bypass guide into the withdrawal duct for the mixture of sifting air and fine material.

5. A wind sifter according to claim 4, wherein the blocking air supply contains a blocking air fan which can be regulated in terms of its supply amount or pressure level.

6. A wind sifter according to claim 5, wherein several subsidiary blocking air lines are distributed over the circumference of the ring seal and are connected to that ring seal.

7. A wind sifter according to claim 4, wherein the ring seal has at least one annular stationary sealing member secured to the inner wall of the withdrawal duct or at least one annular rotating sealing member secured to the appropriate end face, the two sealing members being associated with one another in such a manner as to deflect the supplied airstreams.

8. A wind sifter according to claim 7, wherein several stationary and/or several rotating sealing members are associated with one another in such a manner that they engage in one another approximately in the manner of a labyrinth seal.

* * * * *